US005406911A

United States Patent [19]

Hefley

[11] Patent Number: 5,406,911

[45] Date of Patent: Apr. 18, 1995

[54] CAM-ON-CRANKSHAFT OPERATED VARIABLE DISPLACEMENT ENGINE

[76] Inventor: Carl D. Hefley, 1804 Evergreen St., Burbank, Calif. 91505

[21] Appl. No.: 106,396

[22] Filed: Aug. 12, 1993

[51] Int. Cl.[6] ..... F02B 75/06

[52] U.S. Cl. ..... 123/48 B; 123/78 E

[58] Field of Search ..... 123/193.6, 197.3, 48 R, 123/48 B, 78 R, 78 B, 78 BA, 78 E, 78 F; 74/586, 589

[56] References Cited

U.S. PATENT DOCUMENTS

| | | | |
|---|---|---|---|
| 1,539,769 | 5/1925 | Poillon | 123/78 E |
| 2,356,033 | 8/1944 | Criddle | 123/78 E |
| 4,370,901 | 2/1983 | Bolen | 123/78 E |
| 5,136,987 | 8/1992 | Schechter et al. | 123/48 B |
| 5,146,884 | 9/1992 | Merkel | 123/48 B |
| 5,215,051 | 6/1993 | Smith | 123/78 F |
| 5,279,268 | 1/1994 | Brink et al. | 123/193.6 |

FOREIGN PATENT DOCUMENTS

| | | | |
|---|---|---|---|
| 1441666 | 1/1936 | United Kingdom | 123/48 B |

*Primary Examiner*—Andrew M. Dolinar
*Assistant Examiner*—M. Macy
*Attorney, Agent, or Firm*—Gene W. Arant

[57] ABSTRACT

A variable displacement engine includes a rotatable crankshaft having a journal, a cam having an eccentric opening that receives the crankshaft journal, a piston rod assembly having one end journalled on the eccentric cam, and the cam also having an arcuately extending cavity that has gear teeth formed in its outer wall that are at a constant radius distance from the radial center of the eccentric opening, and a gear wheel disposed within the cavity and engaging the gear teeth for selectively adjusting the angular position of the cam relative to the crankshaft journal.

8 Claims, 3 Drawing Sheets

CAM-ON-CRANKSHAFT OPERATED VARIABLE DISPLACEMENT ENGINE

BACKGROUND OF THE INVENTION

The present invention relates to an internal combustion engine with reduced fuel consumption and increased power and efficiency.

Experience has shown that varying the piston displacement in an internal combustion engine to match load requirements can result in substantial fuel savings. Additionally, adjusting the displacement ratio as the load changes can result in further advantages.

The conventional reciprocating combustion engine uses a piston to compress a working fluid in a cylinder chamber. The fluid is then ignited by a spark and the resultant explosion drives the piston a fixed distance along the length of the cylinder. The energy generated by the ignition, and the subsequent linear movement of the piston, is transmitted through a piston rod which is connected to a rotating crank shaft, by way of bearings or other connection means which allow a pivotal connection to the piston on one end and the crank shaft on the other.

The conventional internal combustion engine is designed so that peak power and peak efficiency are available when the engine operates at full load. As a result, operation of the engine at partial load results in a reduced efficiency. When a conventional engine is operated at less than full load, less power is needed, and the power output is therefore reduced by throttling back the air-fuel mixture. This reduces pressure in the cylinder and increases the residual gas content following combustion, thus resulting in decreased operating efficiency.

The preferred approach to increase efficiency is to adjust the piston displacement or stroke length to obtain the maximum power requirement for each operating regime while maintaining the engine at full throttle. This may be done while either maintaining a fixed compression ratio, or adjusting the compression ratio. Reducing the length of the piston stroke will also reduce friction, thus additionally improving efficiency.

The prior art shows various mechanisms and linkage arrangements for varying the stroke length and compression ratio. However, these designs have now been successfully commercialized, most likely because they were complicated, unreliable or mechanically inoperable. One improved mechanism for varying stroke length and compression ratio is disclosed in my copending application Ser. No. 08/061,013 filed May 14, 1993.

Thus, there is a need for a simple mechanical arrangement which will allow for readily adjustable controlled variation of piston displacement and, if desired, adjustment of compression ratio as the power demand of an engine changes.

SUMMARY OF THE INVENTION

According to the present invention, this need is met by a first adjustment means for adjusting the length of the piston stroke so as to adjust piston displacement. The first adjustment mechanism includes an eccentric cam which is selectively rotatable on the crankshaft journal for adjusting the length of the piston stroke. A second adjustment means allows a controlled change of the effective length of the piston rod by adjusting the actual length of the piston rod along its longitudinal axis.

DRAWING SUMMARY

DETAILED DESCRIPTION OF PREFERRED EMBODIMENT

Reference is now made to the drawings wherein the presently preferred embodiment of the invention is illustrated in detail.

Figure 1:
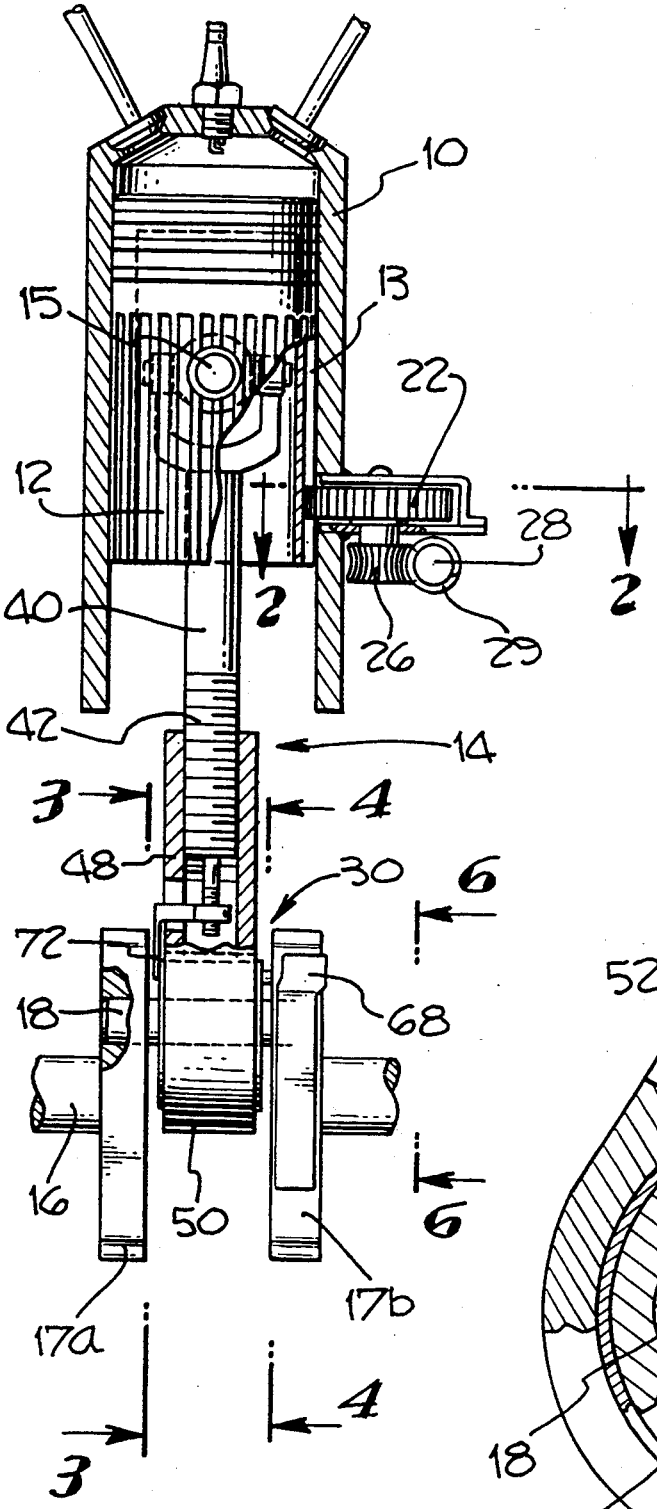
FIG. 1 is a longitudinal cross-sectional view of a cylinder, associated piston, and piston rod assembly, in accordance with the presently preferred form of the invention.

As shown in FIG. 1, an engine cylinder 10 has a piston 12 reciprocably received therein. The piston drives a piston rod assembly 14 whose upper end as shown in FIG. 1 is coupled through a U-joint 15 to the piston. A rotatable crankshaft 16 has a journal 18 through which the reciprocating movement of the piston rod assembly imparts rotation to it.

In accordance with the invention a first adjustment mechanism 30 is provided for selectively adjusting the angular position of an eccentric cam 32 relative to the crankshaft journal, and hence the effective radius of rotation of that journal, so as to adjust the length of the piston stroke. A second adjustment mechanism 20 is selectively operable for adjusting the actual length of the piston rod as measured along its longitudinal axis. The various parts will now be described in more detail.

The piston rod assembly 14 includes a main or upper section 40 and a lower section 48. Piston rod section 40 on its upper end has the usual bifurcated arm rotatably coupled to a piston pin which, in this instance, is coupled through the U-joint 15 to the piston 12. The lower end of piston rod section 40 is threaded at 42, and is received within the lower piston rod section 48. Section 48 is a hollow housing which is internally threaded so that rotation of the upper piston rod section 40 relative to the lower piston rod section 48 will vary the actual length of the piston rod assembly along its longitudinal axis. From the lower end of the lower piston rod section 48 a collar 50 extends downwardly for engaging the crankshaft journal 18. The collar 50 is shown in FIGS. 1, 3, 4, 6, and 7.

Figure 2:
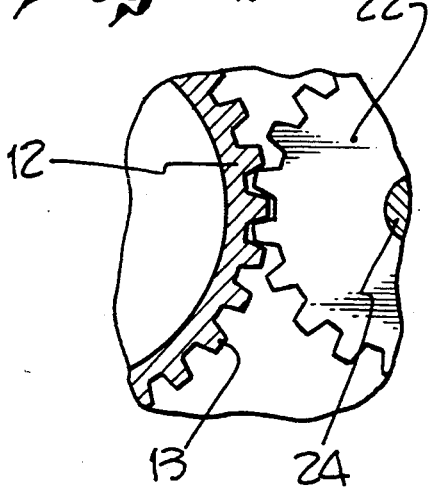
FIG. 2 is a fragmentary detail view taken on Line 2—2 of FIG. 1.

The details of second adjustment mechanism 20 are shown in FIGS. 1 and 2. An opening is provided in one side wall of the engine cylinder 10, and a gear wheel 22 is mounted for rotation such that it projects slightly into the interior space of the cylinder. Piston 12 on the lower part of its exterior surface is provided with longitudinally extending gear teeth 13, as best seen in FIG. 2. The teeth of gear wheel 22 engage with the teeth 13, so that as gear wheel 22 is drivingly rotated it causes the piston 12 to rotate about its longitudinal axis. Gear wheel 22 is fixedly mounted on a shaft 24, the other end of which fixedly carries another and smaller gear wheel 26. A rod 28 located in the plane of gear wheel 26 has a worm gear 29 formed thereon, which engages the teeth of gear wheel 26. When rod 28 is drivingly rotated it causes the gear wheels 26 and 22 to rotate, thereby rotating the piston 12 and the upper piston rod section 40.

The first adjustment mechanism 30 is provided for selectively adjusting the angular position of an eccentric cam relative to the crankshaft journal, and hence the effective radius of rotation of that journal, so as to adjust the length of the piston stroke. The eccentric cam 32 is rotatably received within the collar 50 and is a portion of the first adjustment mechanism 30, described in more detail in later paragraphs.

Figure 3:
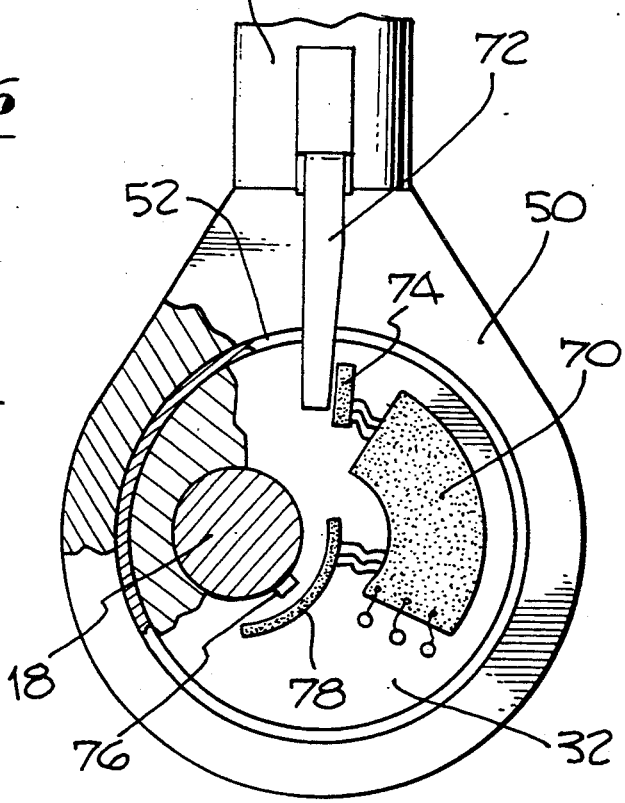
FIG. 3 is a longitudinal cross-sectional view of the coupling of the piston rod assembly to the crankshaft journal, taken from the left side of FIG. 1 on Line 3—3 thereof, also showing associated indicator mechanisms.
Figure 4:
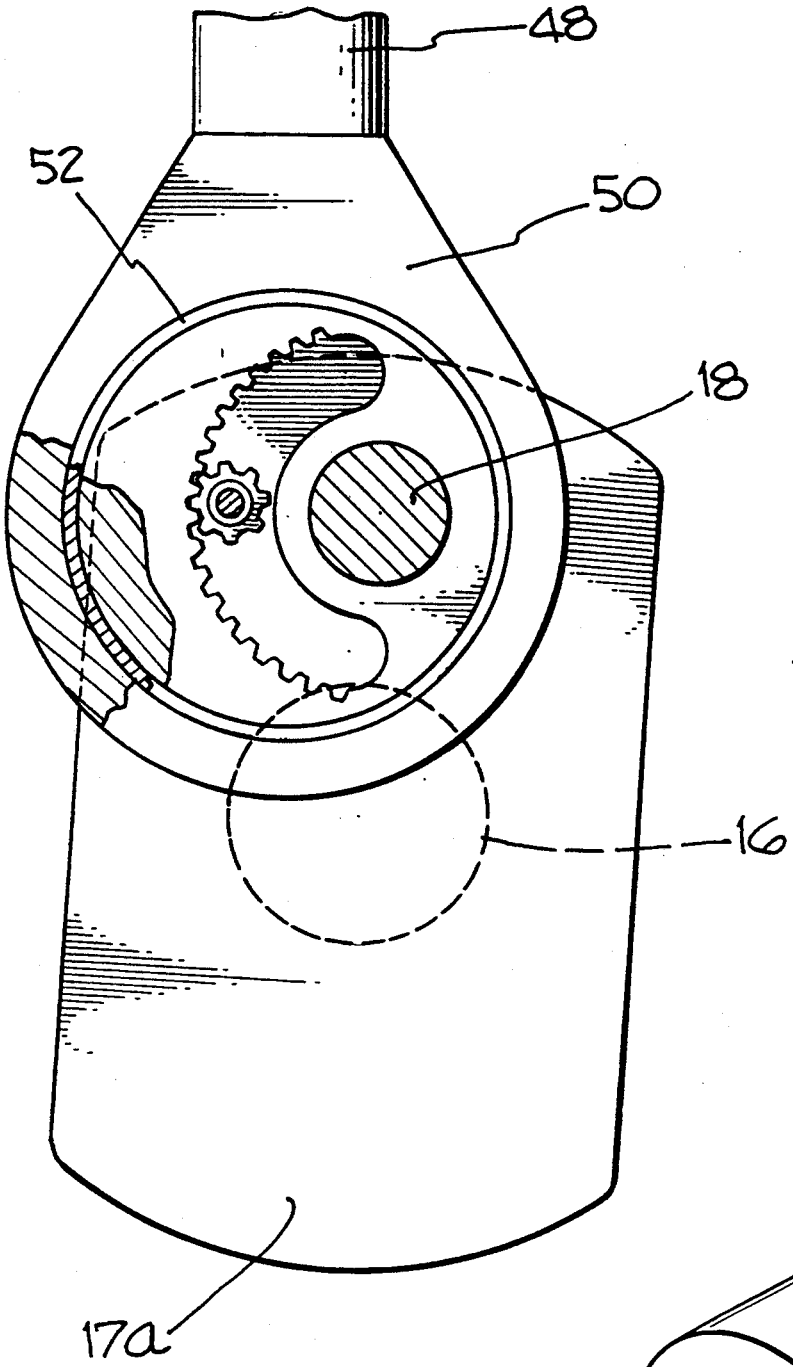
FIG. 4 is a longitudinal cross-sectional view of the coupling of the piston rod assembly to the crankshaft journal, taken from the right side of FIG. 1 on Line 4—4 thereof.
Figure 5:
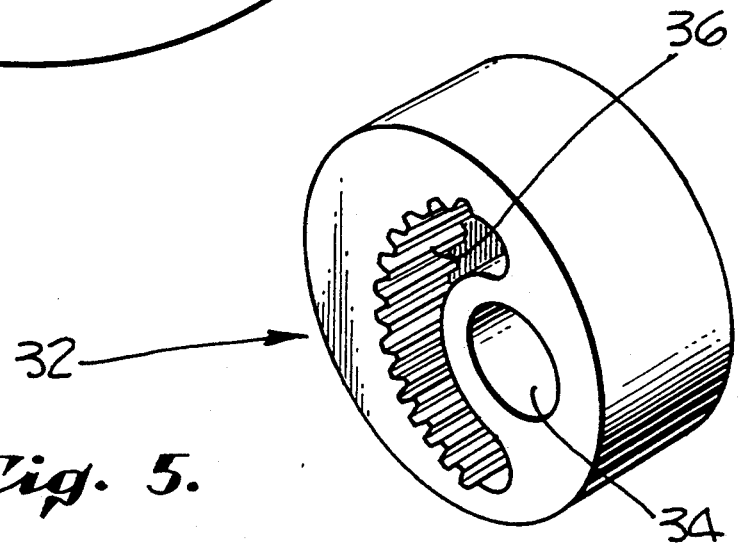
FIG. 5 is a perspective view of the cam that adjusts the length of the piston stroke.

FIG. 3 shows a full side view of the collar 50 that forms the bottom extremity of the piston pin assembly 14. It also shows, partially in cross-section, the eccentric cam 32. As perhaps best seen in FIG. 5, the cam 32 has a cylindrical exterior surface which is therefore adapted to form a rotating joint with the interior surface of collar 50. This joint is completed by the insertion of the bushing 52, FIGS. 3, 4, 6, and 7. A circular hole or opening 34 is formed in the cam which is parallel to the longitudinal axis of the cam but eccentrically located relative to that axis. There is also an arcuately extending cavity 36 which has gear teeth formed in its outer wall. As may best be seen in FIG. 4, all of the gear teeth of the cavity 36 are at a constant radius distance from the radial center of, and hence longitudinal axis of, the opening 34.

Figure 7:
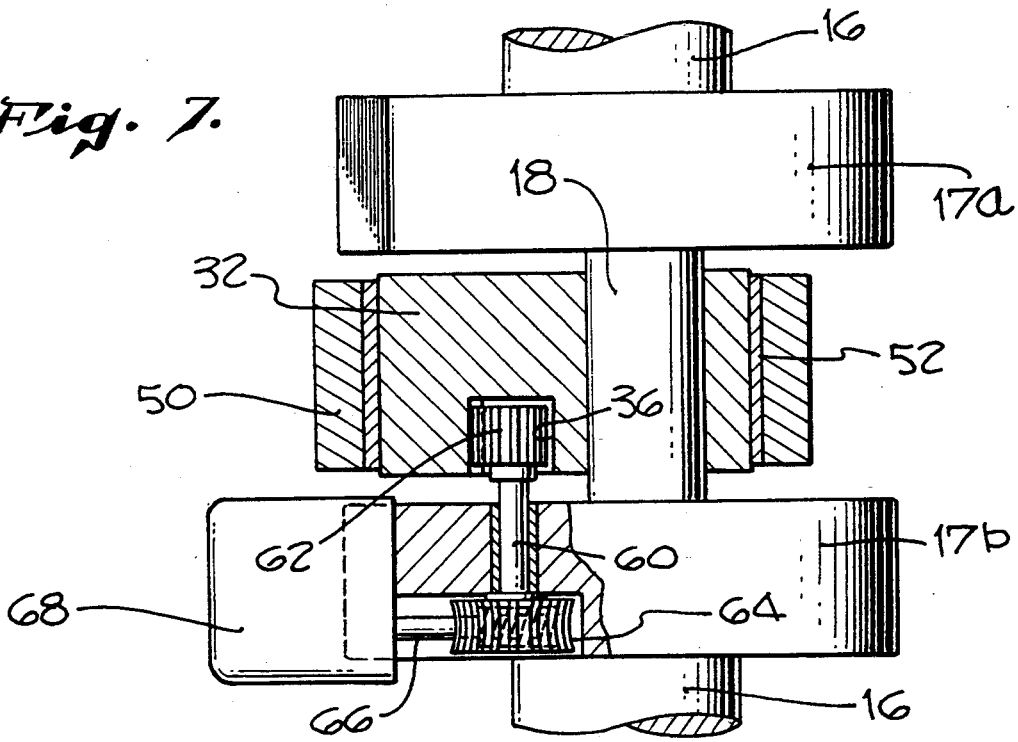
FIG. 7 is a transverse cross-sectional view of the lower end of the piston rod assembly taken on Line 7—7 of FIG. 6, and also showing the main crankshaft and crankshaft journal.

As best shown in FIG. 7, opening 34 extends through the entire width of the eccentric cam 32, and the driven crankshaft journal 18 extends entirely through that opening. The cavity 36, however, extends only partially through the width or thickness of the eccentric cam 32.

Figure 6:
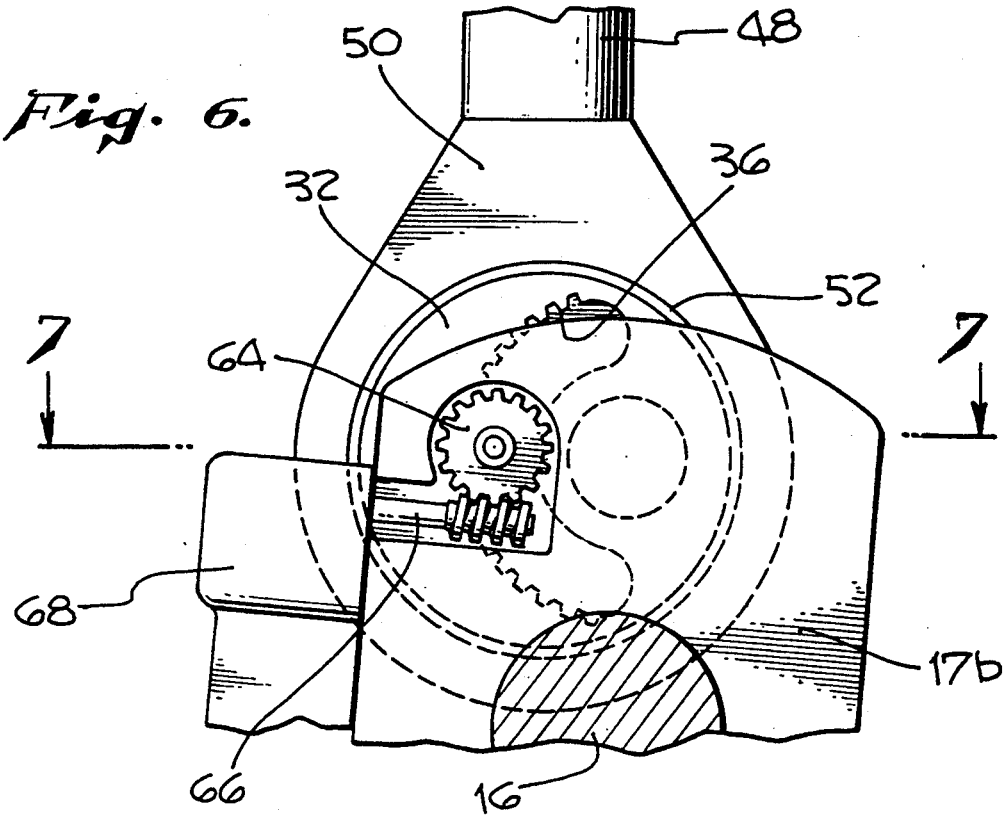
FIG. 6 is a longitudinal cross-sectional view of the coupling of the piston rod assembly to the crankshaft journal, taken from the right side of FIG. 1 on Line 6—6 thereof.

A pair of crankshaft counterbalance weights **17*a*, 17*b*, are integral parts of the crankshaft 16 on the respective ends of the journal 18. A small shaft 60 is rotatably journalled in a fixed position in the crankshaft weight 17*b* and has one end projecting toward the eccentric cam 32. That end of shaft 60 carries a fixed gear 62 that extends into the arcuate cavity 36 and engages the gear teeth of the cavity 36. On the other end of shaft 60 there is a fixed gear 64. A control rod 66 rotatably received in a cavity in the crankshaft weight 17*b* is located in the plane of gear 64 and carries a worm gear that engages the teeth of gear 64. Control rod 66 is the output of a servo motor 68 and is driven in rotation by it. The motor 68 is mounted on one side of the counterbalance weight 17*b* (FIGS. 1, 6, and 7). Those details are most clearly shown in FIGS. 6 and 7**.

OPERATION AND CONTROL

The maximum adjustment of eccentric cam 32 relative to the journal 18 is through an angle of ninety degrees. Servo motor 68 may preferably be a stepper motor which receives individual pulses of electrical energy for changing the position its output shaft 66. It will then hold the rotationally adjusted position of cam 32 until another input pulse is received.

It is advantageous to monitor the engine operation by directly observing the action of the piston in responding to each individual fuel explosion. For that purpose it may be desirable to utilize sensing apparatus such as that shown in FIG. 3. A CPU 70 is mounted in a recess in one surface of the cam 32, being that surface which is adjacent the counterweight **17*a* as shown in FIG. 7. A sensor magnet 74 associated with the CPU is also mounted in a recess in the cam surface. A downwardly extending arm 72 driven from the rotation of piston rod upper portion 40 provides an input signal to the sensor 74 each time that the crankshaft journal 18 completes a full revolution. A small protrusion 76 on the journal 18 provides an indication to a sensor 78 of the rotational position of cam 32 relative to the journal 18**. In this manner a single CPU may receive signals indicating present positions of both parts of the mechanism that are being adjusted and controlled.

It may be desired to add a simple commutator on the opposite surface of the cam 32, being that surface which is adjacent the counterweight **17*b* as shown in FIG. 1 or FIG. 7**. The same commutator may be employed for bringing electric power both to the CPU and to the servo motor, and may also convey output signals from the CPU to the servo motor.

It will therefore be seen that by applying suitable drives to the rotating rod 66 and the rotating rod 28 both the piston displacement and the displacement ratio can be adjusted to match the load requirements on the engine. It will be appreciated that various arrangements of control systems are possible. It is most advantageous to utilize an electronically based system that can respond rapidly to relatively small changes in engine demand. In general, any suitable method may be used for detecting the changes in engine demand, and whenever an adjustment is made in the piston stroke a corresponding adjustment may be made in the displacement ratio.

ALTERNATE FORMS

Although the invention has been described in the context of a an internal combustion engine with variable piston displacement and variable compression, the variable displacement mechanism may if desired be used in an entirely different setting. For example, it may be utilized in a pump, when the speed of the driving engine is to be maintained constant but it is desired to adjust the output volume.

Although in the present embodiment it is the upper piston rod section that is rotated, it will nevertheless be understood that by a different arrangement of parts it would be possible to instead rotate the lower rod section.

Although a preferred embodiment of the present invention has been disclosed in detail in order to comply with the patent laws, it will be understood that the scope of the invention is to be measured only by the appended claims.

What I claim is:

1. In a variable displacement engine, the combination comprising:

a rotatable crankshaft having a journal, an eccentric cam carried on said crankshaft journal, a piston rod assembly having one end journalled on said eccentric cam, and means for selectively adjusting the angular position of said eccentric cam relative to said crankshaft journal so as to adjust the effective radius of rotation of the journalled end of said piston rod assembly and hence the length of the piston stroke.

2. A variable displacement engine as in claim 1 wherein said eccentric cam has a cylindrical exterior surface adapted to form a rotating joint with the piston rod assembly;

said cam has a circular opening formed therein that is parallel to the longitudinal axis of the cam but eccentrically located relative to that axis;

said cam also has an arcuately extending caity that has gear teeth formed in its outer wall, all of said gear teeth being at a constant radial distance from the radial center of said circular opening; and said engine further including a gear wheel disposed within said cavity and selectively rotatable for adjusting the angular position of said cam relative to the associated crankshaft journal.

3. A variable displacement engine as in claim 2 which includes a crankshaft counterbalance weight, a small shaft rotatably journalled in a fixed position within said crankshaft counterbalance weight, and wherein said small shaft has one end projecting toward said eccentric cam and drivingly secured to said gear wheel.

4. In a variable compression engine having a cylinder, a piston reciprocable within the cylinder, an elongated piston rod having one end driven in a reciprocating movement by the piston, and a rotatable crankshaft having a journal to which a rotary motion is imparted by the reciprocating movement of the other end of the piston rod, the improvement characterized by:

a first adjustment mechanism including an eccentric cam carried on the crankshaft journal, and means for selectively adjusting the angular position of said .cam relative to said crankshaft journal so as to adjust the length of the piston stroke;

the piston rod being in the form of an assembly having two longitudinal sections that are threadedly coupled together;

a second adjustment mechanism for selectively rotating one section of the piston rod assembly relative to the other so as to adjust the actual length of the piston rod along its longitudinal axis; and the other end of the piston rod being rotatably journaled upon said cam.

5. A variable compression engine as in claim 4 wherein the lower end of said piston rod assembly has a collar that extends downwardly for engaging the crankshaft journal;

said eccentric cam is rotatably received within said collar; and said first adjustment mechanism selectively adjusts the angular position of said eccentric cam relative to the crankshaft journal and hence the effective radius of rotation of that journal.

6. A variable compression engine as in claim 4 wherein said piston rod assembly includes an upper section having on its upper end a bifurcated arm rotatably coupled to a piston pin which is coupled to the piston;

the lower end of the piston rod upper section being threaded and received within a lower piston rod section;

the lower section being a hollow housing which is internally threaded so that rotation of the upper piston rod section varies the actual length of the piston rod assembly along its longitudinal axis.

7. A variable compression engine as in claim 6 wherein the lower end of said lower piston rod section has a collar that extends downwardly for engaging the crankshaft journal.

8. A variable compression engine as in claim 4 wherein the piston rod assembly has upper and lower sections that are threadedly coupled together, the engine cylinder has a side wall in which an opening is provided, a gear wheel is mounted for rotation such that it projects through said opening and slightly into the interior space of the cylinder, and the piston on the lower part of its exterior surface is provided with longitudinally extending gear teeth that are engaged by the teeth of said gear wheel so that as said gear wheel is drivingly rotated it causes the piston to rotate about its longitudinal axis and thereby vary the length of said assembly.

* * * * *